US011668454B2

(12) United States Patent
Jie

(10) Patent No.: US 11,668,454 B2
(45) Date of Patent: Jun. 6, 2023

(54) WORK LIGHT ASSEMBLY

(71) Applicant: Lumi Legend Electrical Co. LTD, Ningbo (CN)

(72) Inventor: Xu Jie, Ningbo (CN)

( * ) Notice: Subject to any disclaimer, the term of this patent is extended or adjusted under 35 U.S.C. 154(b) by 28 days.

(21) Appl. No.: 17/388,538

(22) Filed: Jul. 29, 2021

(65) Prior Publication Data

US 2023/0033500 A1 Feb. 2, 2023

(51) Int. Cl.

| | |
|---|---|
| ***F21V 21/06*** | (2006.01) |
| ***F21V 17/02*** | (2006.01) |
| ***F21V 21/40*** | (2006.01) |
| ***F21V 5/00*** | (2018.01) |
| ***F21V 23/04*** | (2006.01) |
| ***F21V 23/00*** | (2015.01) |
| ***F21S 4/28*** | (2016.01) |
| ***F21Y 115/10*** | (2016.01) |

(52) U.S. Cl.

CPC ..... *F21V 21/06* (2013.01); *F21S 4/28* (2016.01); *F21V 5/00* (2013.01); *F21V 17/02* (2013.01); *F21V 21/40* (2013.01); *F21V 23/002* (2013.01); *F21V 23/04* (2013.01); *F21Y 2115/10* (2016.08)

(58) Field of Classification Search

CPC . F21V 21/06; F21V 21/40; F21V 5/00; F21V 17/02; F21V 23/002; F21V 23/04; F21S 4/28; F21Y 2115/10

See application file for complete search history.

(56) References Cited

U.S. PATENT DOCUMENTS

| | | | | |
|---|---|---|---|---|
| 4,477,863 | A | 10/1984 | Walz | |
| 6,169,373 | B1 * | 1/2001 | Riesinger | F21L 14/023 315/307 |
| 9,091,401 | B2 * | 7/2015 | Wong | F21V 14/025 |
| 10,551,042 | B2 | 2/2020 | Garvin | |
| 2010/0039801 | A1 * | 2/2010 | Pelletier | F21L 2/00 362/184 |
| 2010/0238654 | A1 | 9/2010 | Waters | |
| 2011/0157882 | A1 * | 6/2011 | Wessel | F21L 4/027 362/205 |
| 2012/0176767 | A1 * | 7/2012 | Whitfield | F21L 14/023 362/33 |
| 2012/0182749 | A1 | 7/2012 | MacGregor | |
| 2013/0094196 | A1 * | 4/2013 | Wessel | F16M 11/10 362/198 |
| 2014/0140050 | A1 * | 5/2014 | Wong | F21V 14/025 362/217.1 |
| 2016/0348879 | A1 | 12/2016 | Young | |

(Continued)

*Primary Examiner* — Mary Ellen Bowman

(57) ABSTRACT

A work light assembly for providing 360° illumination for a workspace includes a base and an illumination module, which is cylindrical. A first leg is engaged to the base and extends along the base from proximate to an upper end and linearly past a lower end thereof. A plurality of second legs extends from the base, which, along with the first leg support the base on a surface. The illumination module is hingedly engaged by a first end to the base, proximate to the upper end. The illumination module is selectively positionable in a first configuration, in which it extends along the base and past the lower end, and a second configuration, in which it extends transversely from the base and is substantially perpendicular to the surface. A power module is engaged to the illumination module so that the illumination module can provide 360° illumination.

17 Claims, 7 Drawing Sheets

(56) References Cited

U.S. PATENT DOCUMENTS

| | | | | |
|---|---|---|---|---|
| 2016/0356439 | A1* | 12/2016 | Inskeep | F21V 21/30 |
| 2019/0195445 | A1* | 6/2019 | Chien | H01R 33/92 |
| 2021/0033248 | A1* | 2/2021 | Cacciabeve | F21V 21/30 |

* cited by examiner

WORK LIGHT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to light assemblies and more particularly pertains to a new light assembly for providing 360° illumination for a workspace. The present invention discloses a light assembly comprising a base having three legs attached, which can be positioned in a tripodal configuration, and an illumination module hingedly engaged to the base, which can be hinged to so that it is vertical and configured for 360° illumination.

(2) Description of Related Art Including Information Disclosed Under 37 CFR 1.97 and 1.98

The prior art relates to light assemblies. Prior art light assemblies may comprise rods extending from bases with lamps attached, tripods with lamps attached, and tubular lights with fasteners attached, wherein the fasteners can secure the tubular lights in a vertical configuration. What is lacking in the prior art is a light assembly comprising a base having three legs attached, which can be positioned in a tripodal configuration, and an illumination module hingedly engaged to the base, which can be hinged to so that it is vertical and configured for 360° illumination.

BRIEF SUMMARY OF THE INVENTION

An embodiment of the disclosure meets the needs presented above by generally comprising a base and an illumination module, which is cylindrical. A first leg is engaged to the base and extends along the base from proximate to an upper end and linearly past a lower end of the base. A plurality of second legs extends from the base. The first leg and the second legs are configured to support the base on a surface. The illumination module is hingedly engaged by a first end to the base, proximate to the upper end. The illumination module is selectively positionable in a first configuration and a second configuration. In the first configuration, the illumination module extends along the base and past the lower end. In the second configuration, the illumination module extends transversely from the base and is substantially perpendicular to the surface. A power module engaged to the base is selectively operationally engageable to the illumination module so that the illumination module is configured to provide 360° illumination of an area proximate to the illumination module.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
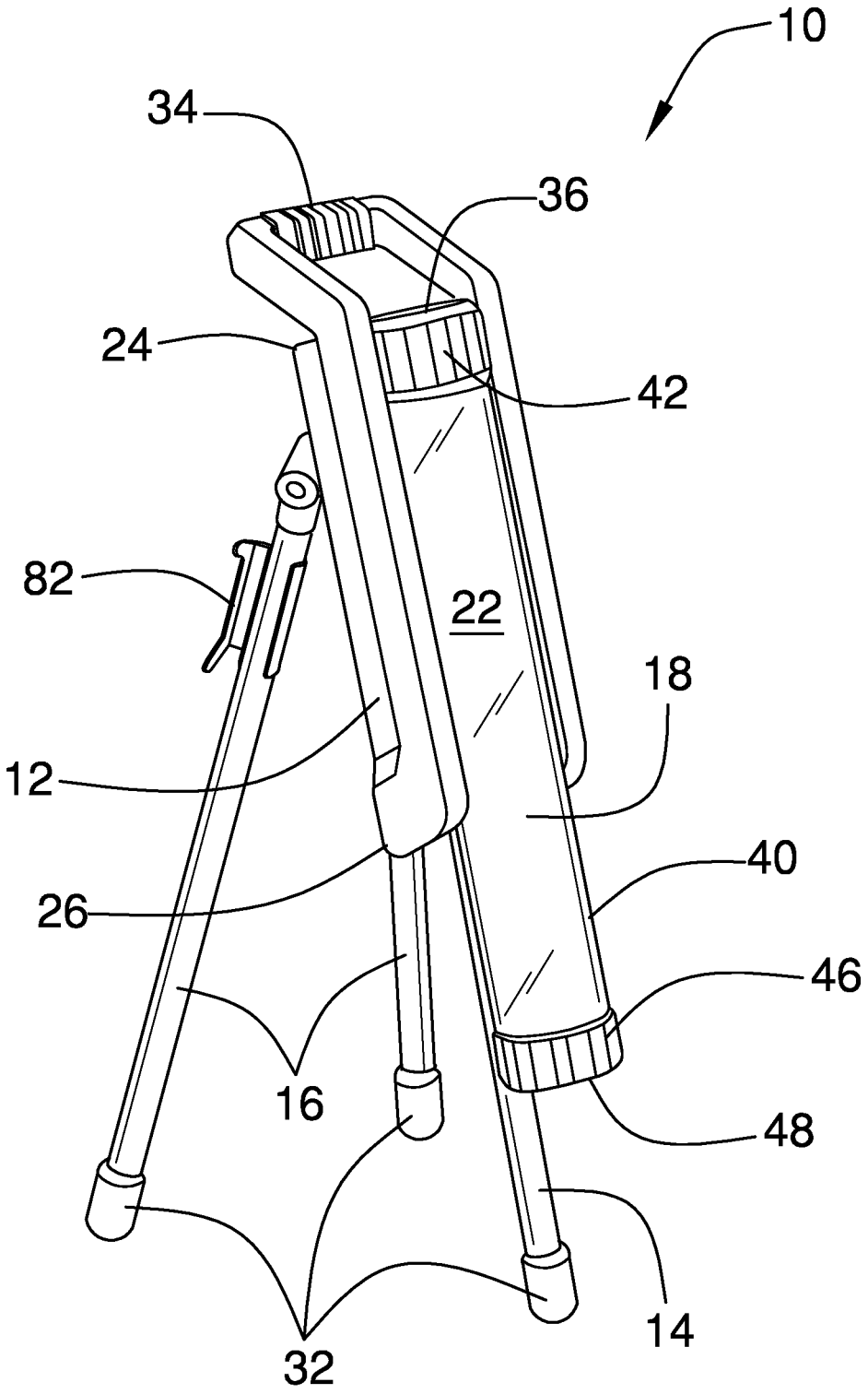
FIG. 1 is a front isometric perspective view of a work light assembly according to an embodiment of the disclosure.
Figure 2:
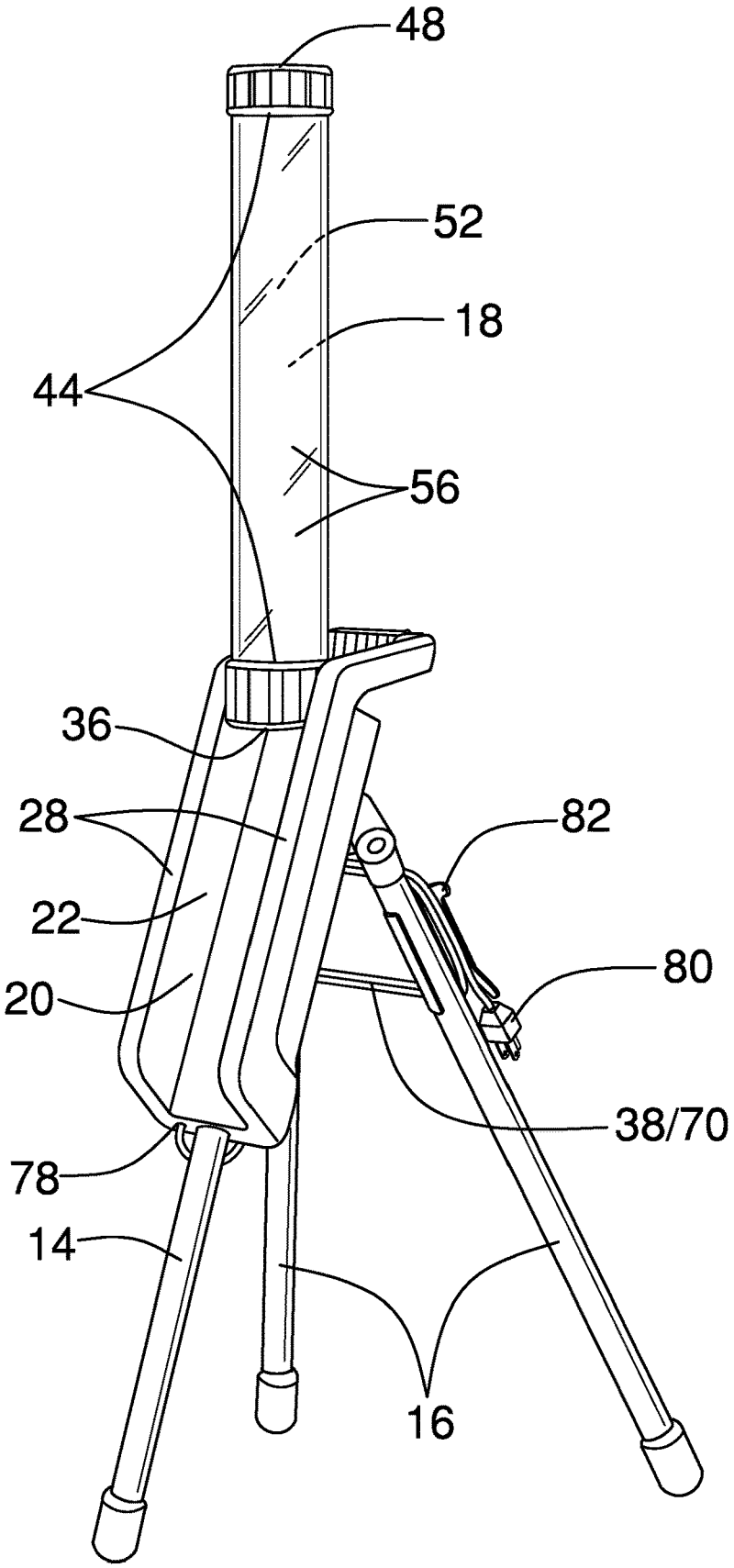
FIG. 2 is a front isometric perspective view of an embodiment of the disclosure.

With reference now to the drawings, and in particular to FIGS. 1 through 8 thereof, a new light assembly embodying the principles and concepts of an embodiment of the disclosure and generally designated by the reference numeral 10 will be described.

As best illustrated in FIGS. 1 through 8, the work light assembly 10 generally comprises a base 12, a first leg 14, a plurality of second legs 16, and an illumination module 18. The base 12 is rectangularly box shaped. A recess 20 extends into an outer face 22 of the base 12 and between an upper end 24 and a lower end 26 of the base 12. The recess 20 defines a pair of rims 28. The outer face 22 of the base 12 may be textured to limit plastic shrinkage and distortion.

Figure 3:
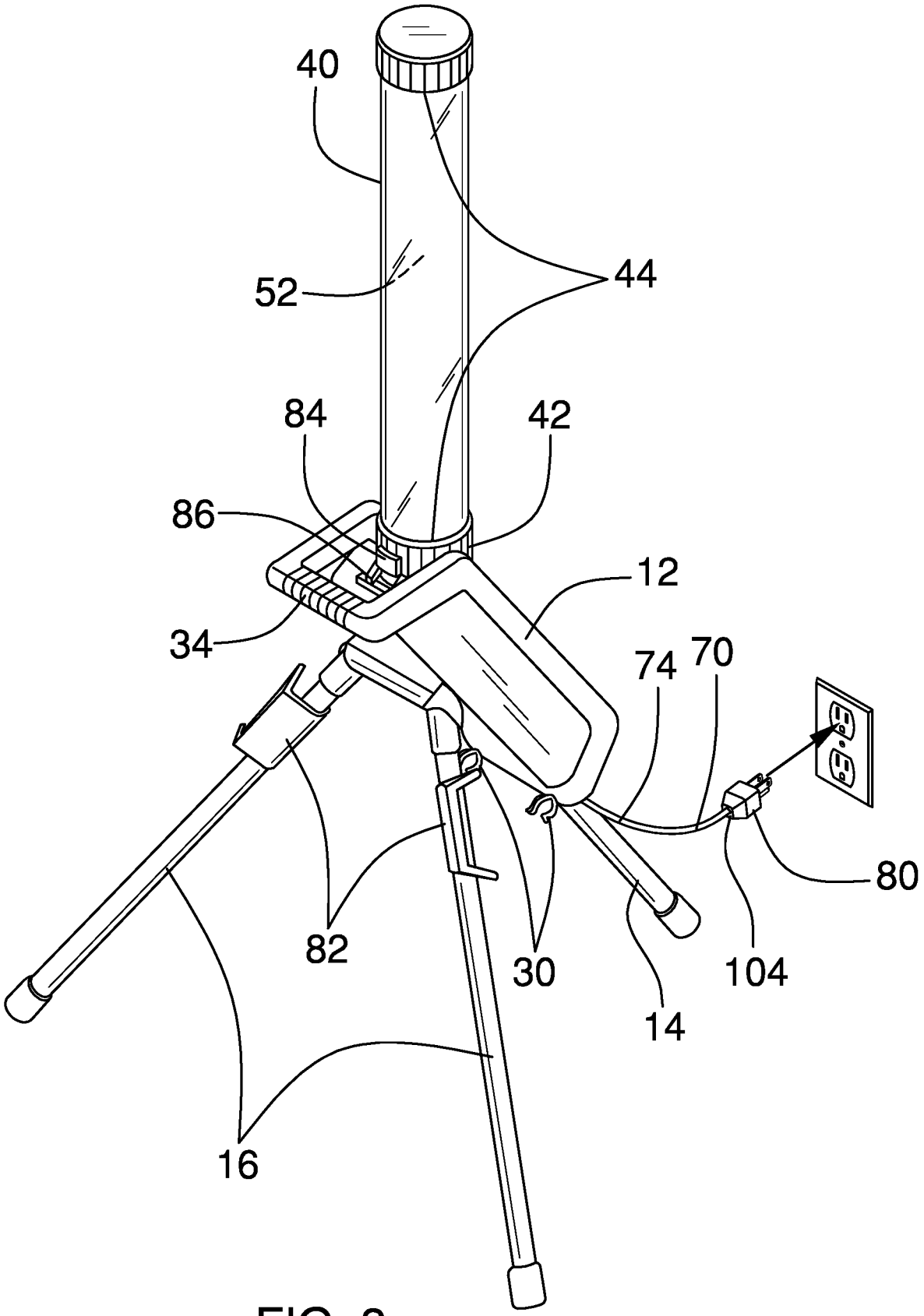
FIG. 3 is a rear isometric perspective view of an embodiment of the disclosure.
Figure 4:
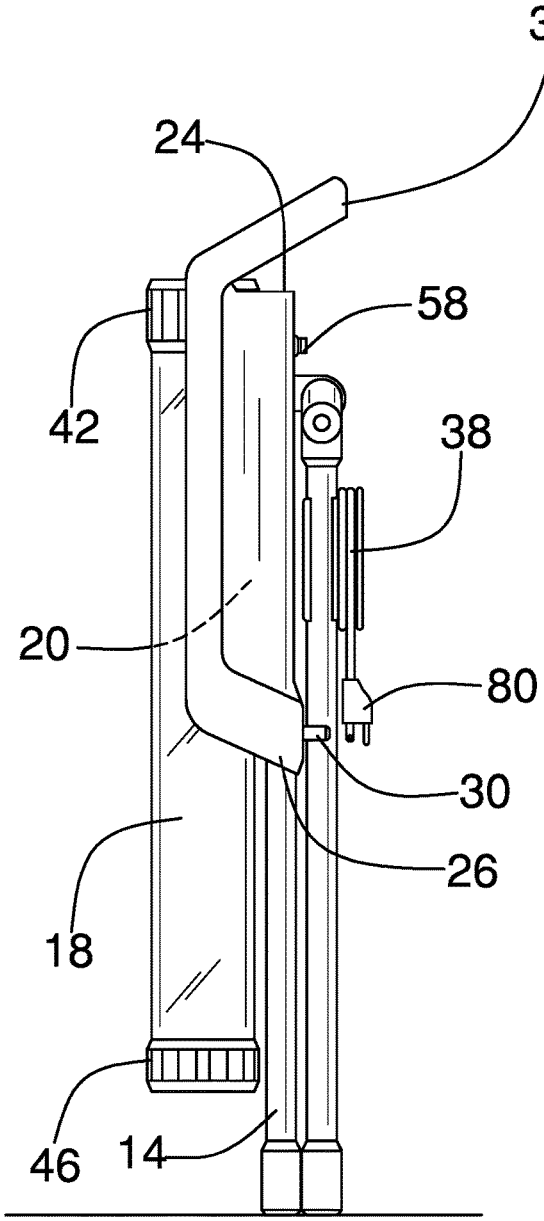
FIG. 4 is a side view of an embodiment of the disclosure.
Figure 5:
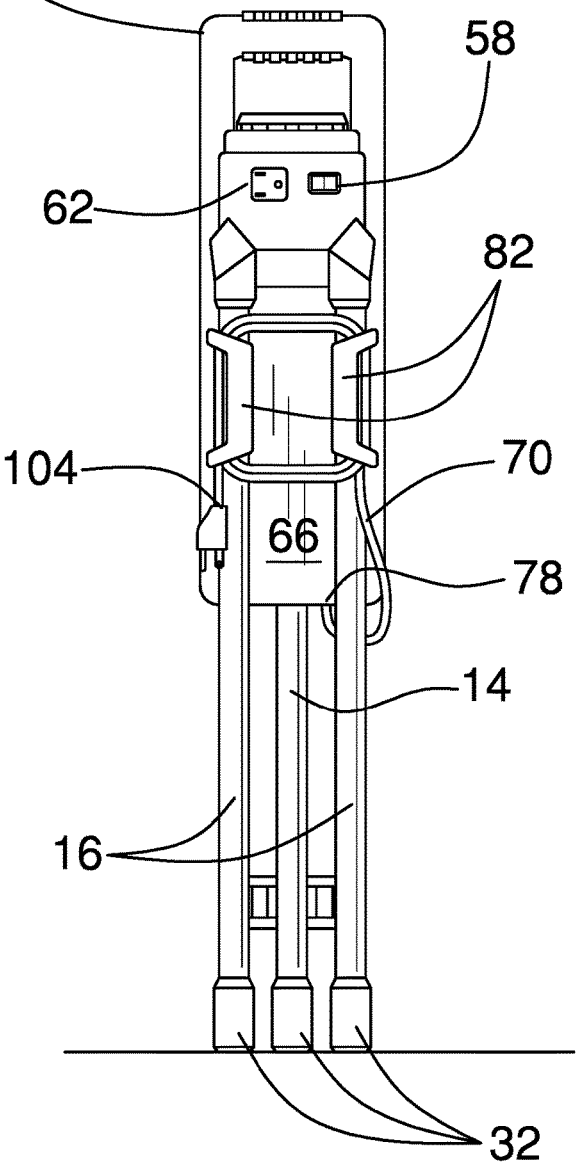
FIG. 5 is a rear view of an embodiment of the disclosure.
Figure 6:
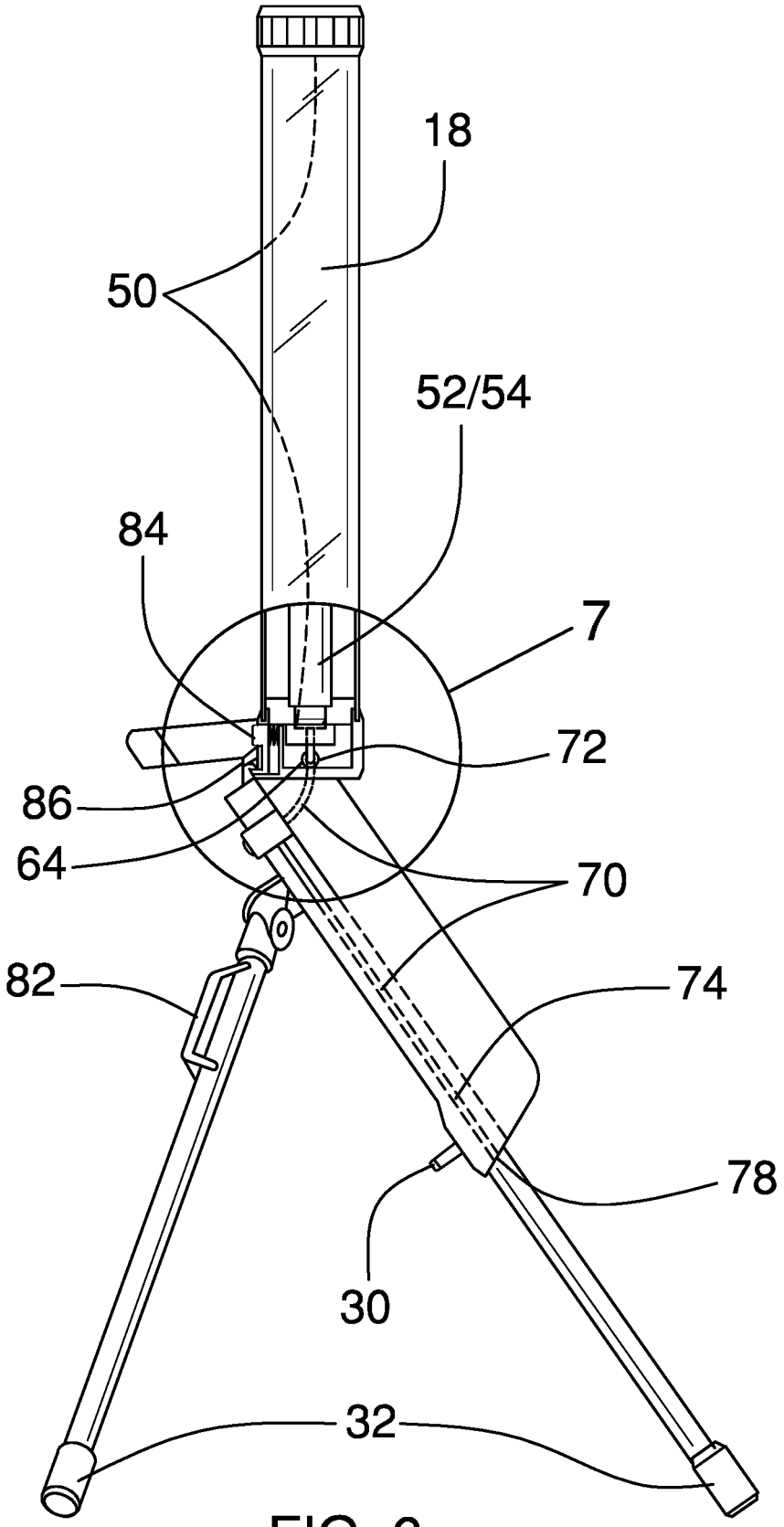
FIG. 6 is a side view of an embodiment of the disclosure.

The first leg 14 is engaged to the base 12 and extends along the base 12 from proximate to the upper end 24 and linearly past the lower end 26 of the base 12. The plurality of second legs 16 extends from the base 12 such that the first leg 14 and the second legs 16 are configured to support the base 12 on a surface. The second legs 16 are hingedly engaged to the base 12 so that the second legs 16 are selectively positionable in a deployed configuration, as shown in FIG. 3, and a stowed configuration, as shown in FIGS. 4 and 5. In the deployed configuration, the second legs 16 extend transversely from the base 12. In the stowed configuration, the second legs 16 are substantially parallel to the first leg 14.

The plurality of second legs 16 may comprise two second legs 16, with the deployed configuration thus being a tripodal configuration. The present invention also anticipates the plurality of second legs 16 comprising four or more second legs 16. Additionally, the present invention anticipates one or more of the first leg 14 and the second legs 16 comprising a plurality of nested sections (not shown). Thus, one or more of the first leg 14 and the second legs 16 may be selectively extensible. With one or more of the first leg 14 and the second legs 16 being selectively extensible, the work light assembly 10 is more readily positionable in a stable position upon an irregular surface.

As shown in FIG. 3, a plurality of clips 30 is engaged to the base 12. Each clip 30 is positioned to engage a respective second leg 16 to retain the respective second leg 16 in the stowed configuration. Each of a plurality of feet 32 is engaged to a respective one of the first leg 14 and the second legs 16 distal from the base 12. The feet 32 comprise one or more of silicone, rubber, and elastomer so that the feet 32 are resiliently compressible. The feet 32 are configured to frictionally engage the surface to deter slippage of the first leg 14 and the second legs 16 across the surface.

A handle 34 is engaged to the base 12 proximate to the upper end 24. The handle 34 is configured to be grasped in a hand of a user, enabling the user to lift or to otherwise maneuver the base 12.

The illumination module 18 is hingedly engaged by a first end 36 to the base 12, proximate to the upper end 24. The illumination module 18, which is cylindrical, is selectively positionable in a first configuration and a second configuration. In the first configuration, the illumination module 18 extends along the base 12 and past the lower end 26. In the second configuration, the illumination module 18 extends transversely from the base 12 and is substantially perpendicular to the surface.

A power module 38 engaged to the base 12 is selectively operationally engageable to the illumination module 18 so that the illumination module 18 is configured to provide 360° illumination, generally horizontally around, of an area proximate to the illumination module 18. As shown in FIG. 1, the illumination module 18 also can be actuated in the first configuration to provide illumination in a directed manner due to partial shielding of the illumination module 18 by the base 12. The present invention also anticipates the illumination module 18 being selectively fixable at any degree of hinging between the first configuration and the second configuration.

The illumination module 18 comprises a tube 40, which is substantially transparent so that the tube 40 is configured for transmission of light. A first cap 42 is engaged to one of opposed ends 44 of the tube 40 and defines the first end 36 of the illumination module 18. A second cap 46 is engaged to the other of the opposed ends 44 of the tube 40 and defines a second end 48 of the illumination module 18. A pair of connectors 50 is engaged singly to the first cap 42 and the second cap 46. The connectors 50 are positioned within the tube 40 and are operationally engaged to the power module 38.

Figure 7:
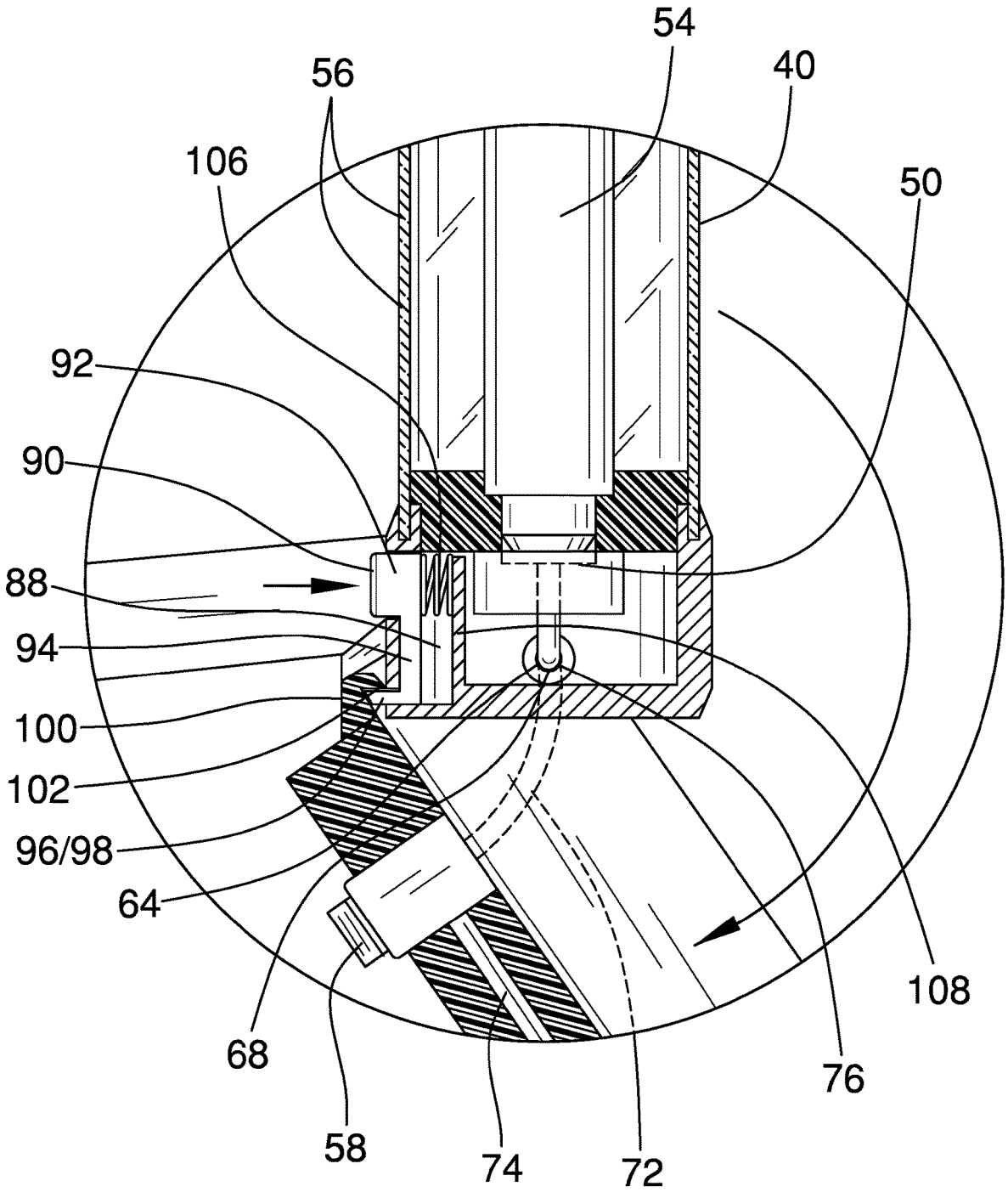
FIG. 7 is a cross-sectional view of an embodiment of the disclosure.
Figure 8:
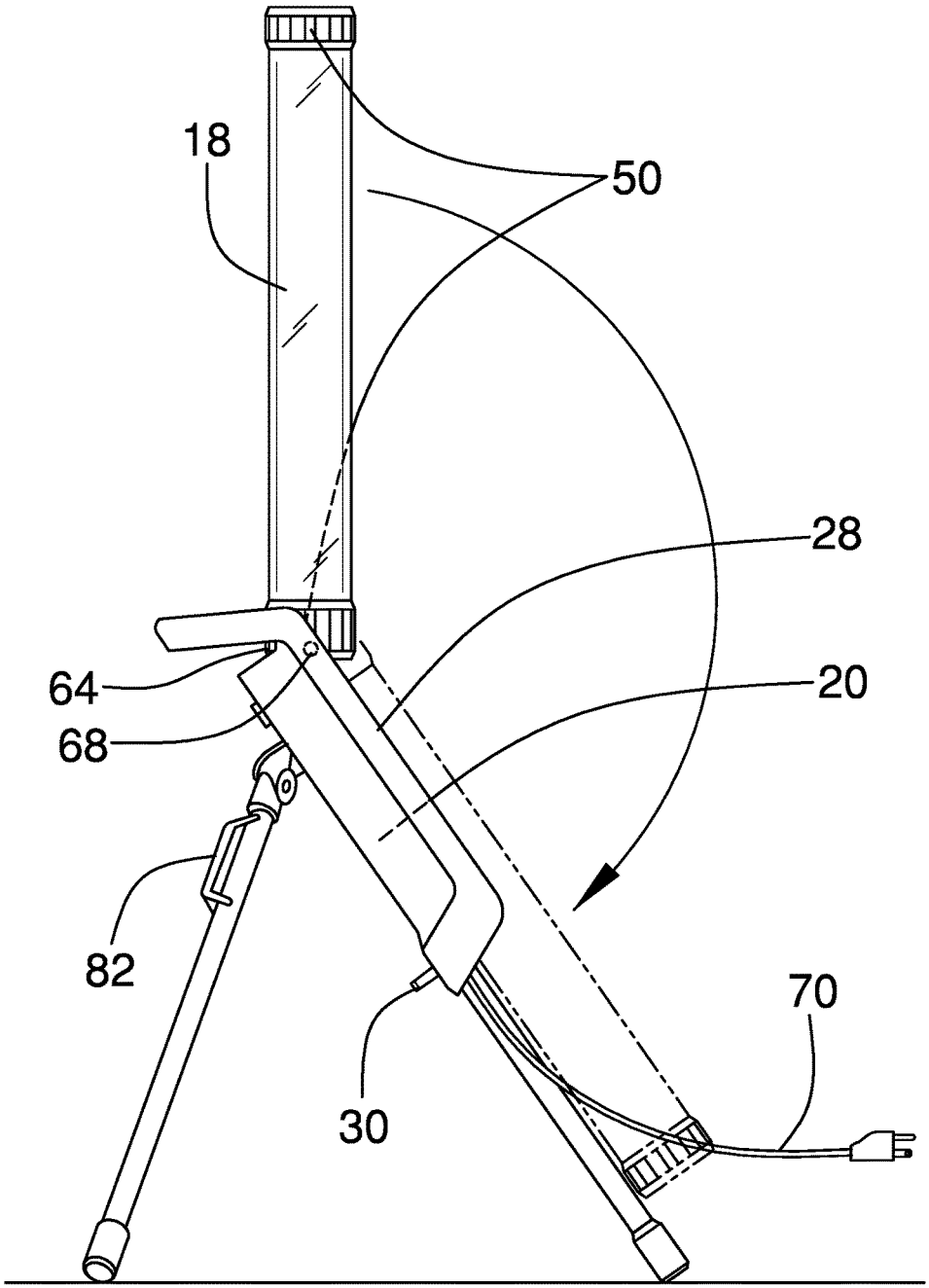
FIG. 8 is an in-use view of an embodiment of the disclosure.

A bulb 52 is selectively engageable to the pair of connectors 50 so that the bulb 52 extends between the connectors 50 and so that the bulb 52 is operationally engaged to the power module 38. The bulb 52 may comprise a tubular light emitting diode 54, as shown in FIG. 7, or other lighting means, such as, but not limited to, fluorescent lights, halogen lights, incandescent lights, laser excited phosphor lights, and the like. The tube 40 may comprise a diffractive optical element 56, such as, but not limited to, ground glass, polycarbonate, polytetrafluoroethylene, and the like, so that the tube 40 is configured to diffuse light. The present invention also anticipates the diffractive optical element 56 being integral to the bulb 52, is which case the tube 40 would be transparent.

A switch 58 is engaged to the illumination module 18 and the power module 38. The switch 58 is positioned to engage the illumination module 18 selectively and operationally to the power module 38. The present invention anticipates the switch 58 comprising buttons, toggles, slides, and the like.

A socket 62 is engaged to the first cap 42 and is operationally engaged to the power module 38. The socket 62 is configured to allow an electronic device (not shown) to be plugged in so that power is supplied to the electronic device. For example, a power tool required to be operated near the rear wall 108 10 can be plugged into the socket 62 and powered.

A hinge pin 64 is engaged to and extends between the rims 28. The hinge pin 64 is positioned distal from an inner face 66 of the base 12 and proximate to the upper end 24, as shown in FIG. 7. The hinge pin 64 passes through a pair of hinge holes 68, which are opposingly positioned in the first cap 42, so that the illumination module 18 is hingedly engaged to the base 12. The recess 20 is positioned for insertion of the illumination module 18 as the illumination module 18 is hinged from the second configuration to the first configuration.

The power module 38 comprises a power cord 70, which comprises a first segment 72 and a second segment 74. The first segment 72 is operationally engaged to and extends between the connector 50 engaged to the first cap 42 and the switch 58. The first segment 72 of the power cord 70 passes through a first cord hole 76, which is positioned in the hinge pin 64. The second segment 74 is operationally engaged to the switch 58 and extends from the switch 58 through the base 12 before exiting the base 12 40 through a second cord hole 78 positioned in the lower end 26 of the base 12. A plug 80 is engaged to a terminus 104 of the second segment 74 distal from the switch. The plug 80 is configured to operationally engage the illumination module 18 to a source of electrical current. A pair of brackets 82 is engaged singly to the second legs 16. The brackets 82 are positioned for winding of the power cord 70 to stow the power cord 70 when not in use. The present invention also anticipates the power module 38 comprising a battery (not shown), which is engaged to or selectively engageable to the base 12.

A first fastener 84 is engaged to the first cap 42. A second fastener 86 is engaged to the base 12 adjacent to the inner face 66 and the upper end 24. The second fastener 86 is complementary to the first fastener 84 and thus is positioned to selectively engage the first fastener 84 to fixedly position the illumination module 18 in the second configuration.

The first fastener 84 comprises a cavity 88 positioned in the first cap 42, as shown in FIG. 7. A release button 90 is positioned in the cavity 88 and extends through a first orifice 92 positioned in the first cap 42. The release button 90 may be textured to enhance frictional contact with a digit of the hand of the user. A spring 106 is engaged to and extends between the release button 90 and a rear wall 108 of the cavity 88. An extrusion 94 is engaged to and extends from the release button 90. A first tab 96 engaged to the extrusion 94 distal from the release button 90 extends through a second orifice 98 positioned in the first cap 42. The first tab 96 is tapered distal from the extrusion 94, as shown in FIG. 7.

The second fastener 86 comprises a protrusion 100 engaged to and extending from the base 12. A second tab 102 is engaged to and extends from the protrusion 100 distal from the base 12. The second tab 102 is tapered distal from the protrusion 100, as shown in FIG. 7. The second tab 102 thus is complementary to the first tab 96 and is positioned to slidably engage the first tab 96 as the illumination module 18 is motivated from the first configuration toward the second configuration. The spring 106 is depressed and the first tab 96 is retracted through the second orifice 98 so that the second tab 102 slides past the first tab 96. The illumination module 18 is positioned in the second configuration and the spring 106 is positioned to rebound and to extend the first tab 96 through the second orifice 98 to lock the illumination module 18 in the second configuration.

The release button 90 is configured to be depressed to disengage the first fastener 84 from the second fastener 86 so that the illumination module 18 is positioned to be hinged from the second configuration to the first configuration. The present invention also anticipates the second fastener 86 and the first fastener 84 comprising other fastening means, such as, but not limited to, spring-loaded pins, thumbscrews, and the like.

In use, the second legs 16 are positioned in the deployed configuration and, along with the first leg 14, are positioned on the surface in a desired location. The power cord 70 is unwound from the brackets 82 and the plug 80 is inserted into a wall socket, as shown in FIG. 3, to power the rear wall 108 10. The illumination module 18 then can be hinged from the first configuration to the second configuration, where it is locked in place by engagement of the first fastener 84 and the second fastener 86. Upon depressing the power button 60, the illumination module 18 is powered up and configured to provide 360° illumination.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A work light assembly comprising:

a base, the base being rectangularly box shaped;

a first leg engaged to the base and extending along the base from proximate to an upper end and linearly past a lower end of the base;

a plurality of second legs extending from the base, wherein the first leg and the second legs are configured for supporting the base on a surface;

an illumination module hingedly engaged by a first end to the base, proximate to the upper end, such that the illumination module is selectively positionable in a first configuration, wherein the illumination module extends along the base and past the lower end, and a second configuration, wherein the illumination module extends transversely from the base and is substantially perpendicular to the surface, the illumination module being cylindrical, wherein the illumination module comprises:

a tube, the tube being substantially transparent, wherein the tube is configured for transmission of light;

a first cap engaged to one of opposed ends of the tube and defining the first end of the illumination module;

a second cap engaged to the other of the opposed ends of the tube and defining a second end of the illumination module;

a pair of connectors engaged singly to the first cap and the second cap, the connectors being positioned within the tube, the connectors being operationally engaged to the power module; and a bulb selectively engageable to the pair of connectors such that the bulb extends between the connectors;

a power module engaged to the base and being selectively operationally engageable to the illumination module, wherein the illumination module is configured for 360° illumination of an area proximate to the illumination module;

a switch engaged to the illumination module and the power module, such that the switch is positioned for selectively operationally engaging the illumination module to the power module;

a recess extending into an outer face of the base and between the upper end and the lower end of the base defining a pair of rims, such that the recess is positioned for insertion of the illumination module as the illumination module is hinged from the second configuration to the first configuration; and a hinge pin engaged to and extending between the rims, the hinge pin being positioned distal from an inner face of the base and proximate to the upper end, the hinge pin passing through a pair of hinge holes opposing positioned in the first cap, such that the illumination module is hingedly engaged to the base.

2. The work light assembly of claim 1, wherein the second legs are hingedly engaged to the base, such that the second legs are selectively positionable in a deployed configuration, wherein the second legs extend transversely from the base, and a stowed configuration, wherein the second legs are substantially parallel to the first leg.

3. The work light assembly of claim 2, wherein the plurality of second legs comprises two second legs, such that the deployed configuration is a tripodal configuration.

4. The work light assembly of claim 2, further including a plurality of clips engaged to the base, each clip being positioned for engaging a respective second leg for retaining the respective second leg in the stowed configuration.

5. The work light assembly of claim 1, further including a plurality of feet, each foot being engaged to a respective one of the first leg and the second legs distal from the base, the feet being resiliently compressible, such that the feet are configured for frictionally engaging the surface.

6. The work light assembly of claim 5, wherein the feet comprise one or more of silicone, rubber, and elastomer.

7. The work light assembly of claim 1, further including a handle engaged to the base proximate to the upper end, wherein the handle is configured for grasping in a hand of a user, positioning the user for lifting or maneuvering the base.

8. The work light assembly of claim 1, wherein the bulb comprises a tubular light emitting diode.

9. The work light assembly of claim 1, wherein the tube comprises a diffractive optical element, wherein the tube is configured for diffusing tight.

10. The work light assembly of claim 9, wherein the tube comprises one or more of ground glass, polycarbonate, and polytetrafluoroethylene.

11. The work light assembly of claim 1, further including a switch engaged to the illumination module and the power module, such that the switch is positioned for selectively operationally engaging the illumination module to the power module.

12. The work light assembly of claim 1, further including a socket engaged to the first cap and being operationally engaged to the power module, wherein the socket is configured for plugging in an electronic device, such that power is supplied to the electronic device.

13. The work light assembly of claim 1, further including:

the power module comprising a power cord, the power cord comprising a first segment and a second segment, the first segment being operationally engaged to and extending between the connector engaged to the first cap and the switch, the first segment of the power cord passing through a first cord hole positioned in the hinge pin, the second segment being operationally engaged to the switch, the second segment extending from the switch through the base and exiting the base through a second cord hole positioned in the lower end of the base; and a plug engaged to a terminus of the second segment distal from the switch, wherein the plug is configured for operationally engaging the illumination module to a source of electrical current.

14. The work light assembly of claim 13, further including a pair of brackets engaged singly to the second legs, such that the brackets are positioned for winding of the power cord for stowing the power cord when not in use.

15. The work light assembly of claim 13, further including:

a first fastener engaged to the first cap; and a second fastener engaged to the base adjacent to the inner face and the upper end, the second fastener being complementary to the first fastener, such that the second fastener is positioned for selectively engaging the first fastener for fixedly positioning the illumination module in the second configuration.

16. The work light assembly of claim 15, wherein:

the first fastener comprises:

a cavity positioned in the first cap, a release button positioned in the cavity and extending through a first orifice positioned in the first cap, a spring engaged to and extending between the release button and a rear wall of the cavity, an extrusion engaged to and extending from the release button, and a first tab engaged to the extrusion distal from the release button, the first tab extending through a second orifice positioned in the first cap, the first tab being tapered distal from the extrusion; and the second fastener comprises:

a protrusion engaged to and extending from the base, and a second tab engaged to and extending from the protrusion distal from the base, the second tab being tapered distal from the protrusion, such that the second tab is positioned for slidably engaging the first tab as the illumination module is motivated from the first configuration toward the second configuration, such that the spring is depressed and the first tab is retracted through the second orifice such that the second tab slides past the first tab, such that the illumination module is positioned in the second configuration and the spring is positioned to rebound for extending the first tab for locking the illumination module in the second configuration, wherein the release button is configured for depressing for disengaging the first fastener from the second fastener, such that the illumination module is positioned for hinging from the second configuration to the first configuration.

17. A work light assembly comprising:

a base, the base being rectangularly box shaped;

a first leg engaged to the base and extending along the base from proximate to an upper end and linearly past a lower end of the base;

a plurality of second legs extending from the base, wherein the first leg and the second legs are configured for supporting the base on a surface, the second legs being hingedly engaged to the base, such that the second legs are selectively positionable in a deployed configuration, wherein the second legs extend transversely from the base, and a stowed configuration, wherein the second legs are substantially parallel to the first leg, the plurality of second legs comprising two second legs, such that the deployed configuration is a tripodal configuration;

a plurality of clips engaged to the base, each clip being positioned for engaging a respective second leg for retaining the respective second leg in the stowed configuration;

a handle engaged to the base proximate to the upper end, wherein the handle is configured for grasping in a hand of a user, positioning the user for lifting or maneuvering the base;

a plurality of feet, each foot being engaged to a respective one of the first leg and the second legs distal from the base, the feet being resiliently compressible, such that the feet are configured for frictionally engaging the surface, the feet comprising one or more of silicone, rubber, and elastomer;

an illumination module hingedly engaged by a first end to the base, proximate to the upper end, such that the illumination module is selectively positionable in a first configuration, wherein the illumination module extends along the base and past the lower end, and a second configuration, wherein the illumination module extends transversely from the base and is substantially perpendicular to the surface, the illumination module being cylindrical, the illumination module comprising:

a tube, the tube being substantially transparent, wherein the tube is configured for transmission of light, the tube comprising a diffractive optical element, wherein the tube is configured for diffusing light, the tube comprising one or more of ground glass, polycarbonate, and polytetrafluoroethylene, a first cap engaged to one of opposed ends of the tube and defining the first end of the illumination module, a second cap engaged to the other of the opposed ends of the tube and defining a second end of the illumination module, a pair of connectors engaged singly to the first cap and the second cap, the connectors being positioned within the tube, and a bulb selectively engageable to the pair of connectors such that the bulb extends between the connectors, the bulb comprising a tubular light emitting diode;

a power module engaged to the base and being selectively operationally engageable to the illumination module, wherein the illumination module is configured for 360° illumination of an area proximate to the illumination module, the connectors being operationally engaged to the power module;

a recess extending into an outer face of the base and between the upper end and the lower end of the base defining a pair of rims, such that the recess is positioned for insertion of the illumination module as the illumination module is hinged from the second configuration to the first configuration;

a hinge pin engaged to and extending between the rims, the hinge pin being positioned distal from an inner face of the base and proximate to the upper end, the hinge pin passing through a pair of hinge holes opposing positioned in the first cap, such that the illumination module is hingedly engaged to the base;

a switch engaged to the illumination module and the power module, such that the switch is positioned for selectively operationally engaging the illumination module to the power module;

the power module comprising a power cord, the power cord comprising a first segment and a second segment, the first segment being operationally engaged to and extending between the connector engaged to the first cap and the switch, the first segment of the power cord passing through a first cord hole positioned in the hinge pin, the second segment being operationally engaged to the switch, the second segment extending from the switch through the base and exiting the base through a second cord hole positioned in the lower end of the base;

a plug engaged to a terminus of the second segment distal from the switch, wherein the plug is configured for operationally engaging the illumination module to a source of electrical current;

a pair of brackets engaged singly to the second legs, such that the brackets are positioned for winding of the power cord for stowing the power cord when not in use;

a socket engaged to the first cap and being operationally engaged to the power module, wherein the socket is configured for plugging in an electronic device, such that power is supplied to the electronic device;

a first fastener engaged to the first cap, the first fastener comprising:

a cavity positioned in the first cap, a release button positioned in the cavity and extending through a first orifice positioned in the first cap, a spring engaged to and extending between the release button and a rear wall of the cavity, an extrusion engaged to and extending from the release button, and a first tab engaged to the extrusion distal from the release button, the first tab extending through a second orifice positioned in the first cap, the first tab being tapered distal from the extrusion; and a second fastener engaged to the base adjacent to the inner face and the upper end, the second fastener being complementary to the first fastener, such that the second fastener is positioned for selectively engaging the first fastener for fixedly positioning the illumination module in the second configuration, the second fastener comprising:

a protrusion engaged to and extending from the base, and a second tab engaged to and extending from the protrusion distal from the base, the second tab being tapered distal from the protrusion, such that the second tab is positioned for slidably engaging the first tab as the illumination module is motivated from the first configuration toward the second configuration, such that the spring is depressed and the first tab is retracted through the second orifice such that the second tab slides past the first tab, such that the illumination module is positioned in the second configuration and the spring is positioned to rebound for extending the first tab for locking the illumination module in the second configuration, wherein the release button is configured for depressing for disengaging the first fastener from the second fastener, such that the illumination module is positioned for hinging from the second configuration to the first configuration.

* * * * *